United States Patent [19]

Lorenzo

[11] 4,266,480

[45] May 12, 1981

[54] APPARATUS FOR CONTROLLING INKING MEANS

[75] Inventor: John L. Lorenzo, Southbury, Conn.

[73] Assignee: Pitney Bowes Inc., Stamford, Conn.

[21] Appl. No.: 59,347

[22] Filed: Jul. 20, 1979

[51] Int. Cl.[3] ..... B41F 31/12; B41F 31/38; B41L 27/40

[52] U.S. Cl. ..... 101/351; 101/209

[58] Field of Search ..... 101/351, 352, 350, 349, 101/206, 207, 209, 144, 132.5, 148; 307/293, 262; 318/446

[56] References Cited

U.S. PATENT DOCUMENTS

| | | | |
|---|---|---|---|
| 3,274,932 | 9/1966 | Caza | 101/351 |
| 3,412,676 | 11/1968 | Tonkin et al. | 101/144 |
| 3,750,566 | 8/1973 | Ogawa | 101/144 |
| 3,771,446 | 11/1973 | Kaneko et al. | 101/144 |
| 3,903,793 | 9/1975 | Schubert | 101/351 |

*Primary Examiner*—J. Reed Fisher

*Attorney, Agent, or Firm*—Donald P. Walker; William D. Soltow; Albert W. Scribner

[57] ABSTRACT

In a machine having a printing cycle, and including an inking mechanism, there is provided apparatus for controlling operation of the inking mechanism. The control apparatus comprises a latch including a manually operable switch, a pulse generator coupled to the latch and adapted to be enabled thereby to commence generating pulses in response to momentary operation of the switch, a counter for counting a predetermined number of pulses, instrumentalities for providing an inking enabling signal for a predetermined time interval during at least one of the printing cycles, a gate for gating the pulses to the counter during at least one of the aforesaid time intervals, and means for operating the inking mechanism during the time period the predetermined number of pulses are being counted.

8 Claims, 2 Drawing Figures

APPARATUS FOR CONTROLLING INKING MEANS

BACKGROUND OF THE INVENTION

As shown in U.S. Pat. No. 3,903,793 issued to K. E. Schubert, Sept. 9, 1975, and assigned to the assignee of the present invention, it is known in the art to provide a postage meter having a rotatable printing drum, with an inking mechanism of the type which includes an inking roller contacting the printing drum, an ink reservoir having a supply roller immersed therein, and a transfer roller adapted to be intermittently moved into and out of engagement with the inking and supply rollers for transferring ink between the same and thus between the ink reservoir and printing drum. As discussed in the aforesaid patent the transfer roller is normally spring biased out of engagement with the inking and supply rollers and is urged into engagement with the same by means of an intermittently energized solenoid. Also, although not discussed in the patent, there is also provided a manually actuatable switch which is electrically connected to the solenoid energizing the solenoid from a suitable source of supply of power for the time period during which the switch is manually held actuated by the postage meter operator.

With the above described arrangement the individual postage meter operator is free to exercise his own judgement to decide upon the appropriate length of time for holding the inking switch actuated and learns on a hit-or-miss basis to avoid over-saturation of the inking roller and the concomitant problems of transferring an excessive amount of ink to the printing drum during each cycle of operation; rapidly accumulating residual ink sludge on the printing drum; and ink bleeding from the inking roller to the printing drum when the postage meter is not in use. Accordingly:

An object of the present invention is to provide an improved inking mechanism;

Another object is to provide a machine having a printing cycle and printing means including a source of supply of ink, with apparatus for controlling operation of the inking means; and A further object is to provide apparatus for controlling the operation of roller means operable for inking the indicia imprinting means of a postage meter.

SUMMARY OF THE INVENTION

In a machine having a printing cycle and including inking means, apparatus is provided for controlling operation of the inking means. The apparatus comprises latching means including a manually operable switch, pulse generating means adapted to be enabled by the latching means for commencing generating pulses in response to momentary operation of the switch, means for counting a predetermined number of pulses, means for providing an inking enabling signal for a predetermined time interval during at least one of the printing cycles, means for gating pulses to the counting means during at least one of the time intervals, and means for operating the inking means during the time period the predetermined number of pulses are being counted.

BRIEF DESCRIPTION OF THE DRAWINGS

As shown in the drawings, wherein like reference numerals designate like or corresponding parts throughout the several figures.

DESCRIPTION OF THE PREFERRED EMBODIMENT

Figure 1:
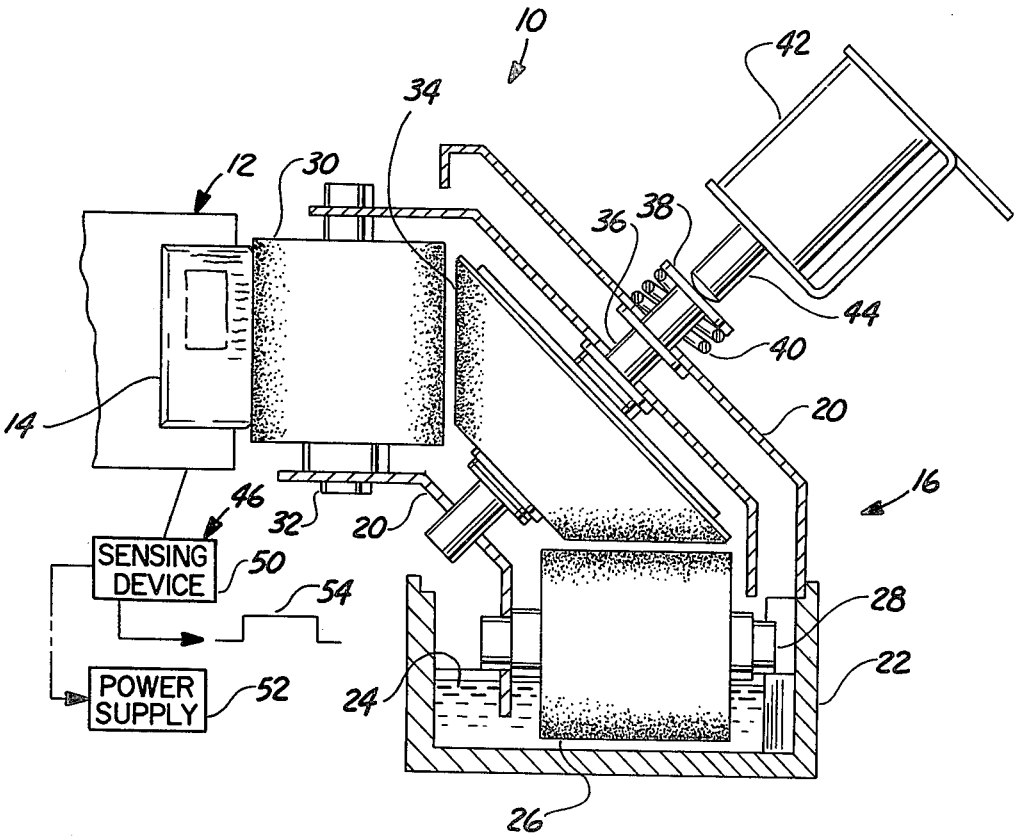
FIG. 1 is a fragmentary sectional view of a postage meter including an inking mechanism of the type which may be operatively controlled by means of the invention; and shows a sensing device operatively coupled to the printing drum of the inking mechanism for providing an inking enabling signal when the drum rotates.

As shown in FIG. 1, a machine of the type which may be improved in accordance with the present invention is preferably a postage meter 10 which generally includes a rotatably mounted printing drum 12, having a circumferentially-extending section comprising a postage indicia printing die 14, and an inking mechanism 16. The inking mechanism 16 generally comprises framework 20 for supporting the various components of the inking mechanism 16 including a reservoir 22 for holding a supply of ink 24 and an ink supply roller 26 immersed in the ink 24. The supply roller 26 is suitably rotatably attached to the framework 20 and mounted within the reservoir 22, as by means of a shaft 28 which is rotatably supported by the framework 20 and reservoir 22. In addition, the inking mechanism 16 includes a die inking roller 30 which is suitably rotatably attached to the framework 20, as by means of a shaft 32 rotatably supported by the framework 20 for engagement by the postage indicia printing die 14 as the printing drum 12 rotates. The inking mechanism 16 additionally includes a transfer roller 34 which is suitably rotatably and axially movably attached to the framework 20, between the supply and inking rollers, 26 and 30, for intermittent rotation in engagement with the respective supply and inking rollers, 26 and 30. To that end the inking mechanism 16 includes a shaft 36 having a stop 38 which is integrally attached to one of the ends of the shaft 36, and a coil spring 40 which encircles the shaft 36 and is seated against the stop 38. The transfer roller 36 is suitably attached to the shaft 36, which is in turn rotatably attached to the framework 20 by well-known means such that the shaft 36 is reciprocably movable in the direction of its axis and the spring 40 is disposed between the framework 20 and stop 38 so as to normally bias the shaft 36 such that the transfer roller 34 is disposed out of engagement with the respective supply and inking rollers, 26 and 30.

For intermittent movement of the transfer roller 34 (FIG. 1) into engagement with the supply and inking rollers, 26 and 30, the inking mechanism 16 further includes a solenoid 42 having a push rod 44 disposed in contact with the shaft 36 for movement thereof against the compression of the spring 40 when the solenoid 42 is actuated; thereby moving the transfer roller 34 between and into engagement with the respective supply and inking rollers, 26 and 30.

As discussed in U.S. Pat. No. 3,903,793 issued Sept. 9, 1975 to K. E. Schubert, the subject matter of which is incorporated herein by reference, assuming the solenoid 42 (FIG. 1) is operated, when the printing drum 12 rotates for printing postage on a letter, the inking roller 30 is rotated by the drum 12, the transfer roller 34 is rotated by the inking roller 30 and supply roller 26 is rotated by the transfer roller 34, to thereby transfer ink 24 from the reservoir 22 to the printing drum 12. As shown in FIG. 1, this occurs when the postage indicia die 14 is rotated into engagement with the inking roller 30. According to the invention there is provided apparatus 46 for controlling operation of the solenoid 42, and thus the inking mechanism 16, for the transfer of ink 24 from the reservoir 22 to the postage indicia die 14.

The apparatus 46 (FIG. 1) for controlling the inking mechanism 16 includes a suitable device 50 such as an electro-mechanically or electro-optically operable switch, or a hall effect device, or electro-magnetic device, or the like, adapted to be connected to a suitable source of supply of power 52 and either directly or indirectly to the printing drum 12, for sensing or responding to rotation of the printing drum 12 and providing an inking enabling signal 54 for a predetermined time interval during each cycle of rotation of the printing drum 12, and thus during each printing cycle of the postage indicia die 14.

Figure 2:
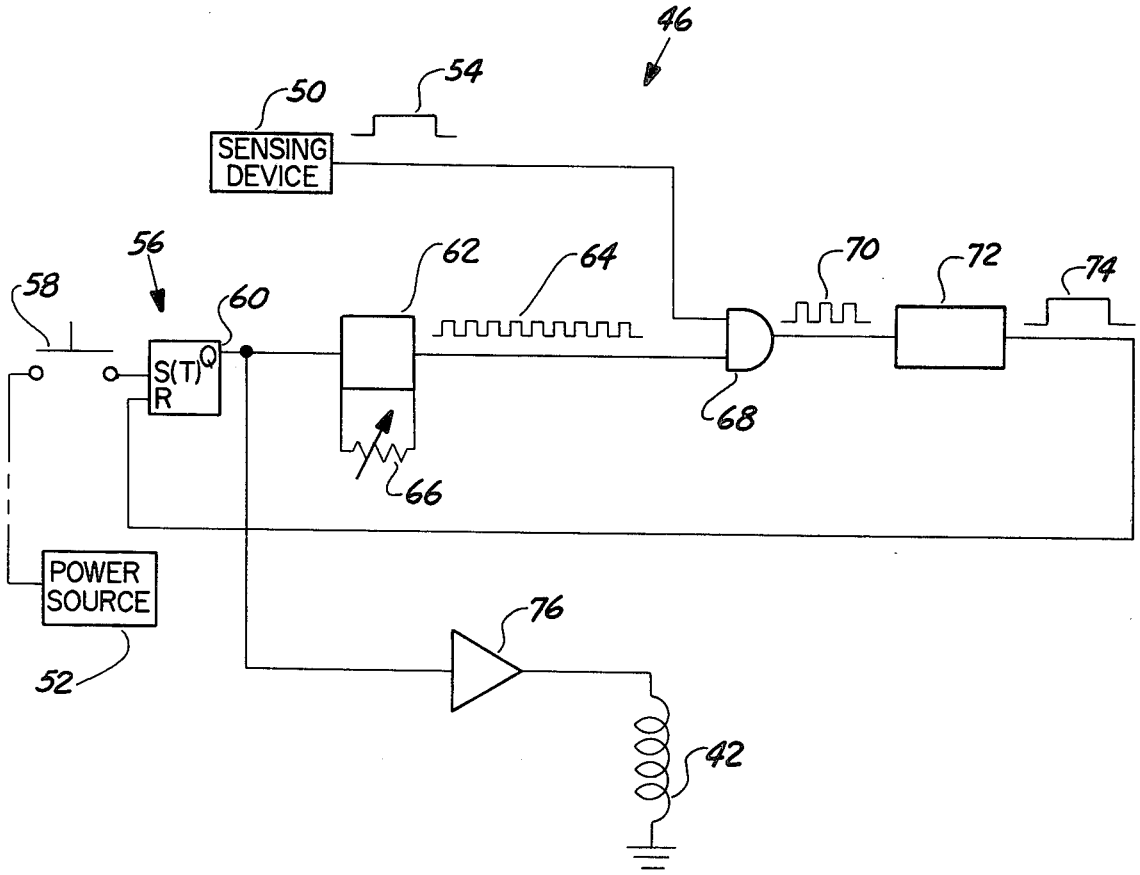
FIG. 2 is a schematic diagram of apparatus according to the invention for controlling operation of an inking mechanism of the type shown in FIG. 1.

As shown in FIG. 2 the control apparatus 46 also includes latching means 56 comprising a manually operable switch 58 and a bistable multivibrator 60. The switch 58 has one terminal thereof suitably electrically connected to the source of supply of power 52 which is preferably the D.C. source of supply of power. And the other switch terminal is suitably electrically connected to the set terminal "S" of the multivibrator 60. The multivibrator 60 is operable in two stable states. In response to a momentary signal at the set terminal "S" the multivibrator 60 is operable in one of the stable states to provide a high level signal at the output terminal "Q". And in response to a momentatry signal at the reset terminal "R" the multivibrator 60 is operable in the other stable state to provide a low level signal at the output terminal "Q".

The control apparatus 46 (FIG. 2) additionally includes oscillating means, such as a conventional astable multivibrator or other pulse generator 62, having the input thereof coupled to the output terminal "Q" of the multivibrator 60 for enablment in response to a momentary signal at the set terminal "S" of the multivibrator 60, and thus to momentary closure of the switch 58, to commence oscillation. In the preferred embodiment the output signal of the pulse generator 62 consists of a train of pulses 64 generated in response to momentary closure of the switch 58. To adjust the frequency with which pulses 64 are generated, the pulse generator 62 preferably includes suitable means such as a manually variable potentiometer 66.

The control apparatus 46 further includes a conventional AND gate 68 suitably coupled to the pulse generator 62 to receive the output signal pulses 64 therefrom, and coupled to the sensing device 50 to receive the inking enabling signal 54 therefrom; such that the pulses 64 from the pulse generator 62 are gated to the output of the AND gate 68 for the time interval during which the inking enabling signal 54 is being received. Accordingly, the AND gate 68 has an output signal of predetermined time duration consisting of a train of pulses 70; and, since the frequency of pulse generation of the pulse generator 62 is adjustable through manual adjustment of the potentiometer 66, the number of pulses 70 in a given AND gate output signal is correspondingly adjustable.

The control apparatus 46 also includes a conventional counter 72 coupled to the output of the AND gate 68 to receive the output signal pulses 70 therefrom, and coupled to the reset terminal "R" of the multivibrator 60 to reset the same for disablment of the pulse generator 62. The counter 72 is adapted by well-known means to count a predetermined total number of pulses before generating a reset output signal 74 for resetting the multivibrator 60. Preferably, the counter 72 is a conventional fourteen or twenty-one stage integrated circuit-type counter having a total pulse count capability greater than the total number of pulses 70 gated to the counter 72 during the time interval of a single inking enabling signal 54, as a result of which more than one inking enabling signal 54 may be needed to cause the counter 72 to generate a reset output signal 74.

The control apparatus 46 (FIG. 2) additionally includes suitable means 76 for driving the solenoid 42, such as a Darlington configuration power transistor having the output thereof coupled to the solenoid 42 and the input thereof coupled to the output terminal "Q" of the multivibrator 60, for enablement of the solenoid 42 in response to a high level signal being provided at the output terminal "Q" of the multivibrator 60, and for disablement of the solenoid 42 in response to a low level signal being provided at the output terminal "Q" of the multivibrator 60.

With the above arrangement of control apparatus 46 (FIG. 2), the operator momentarily actuates the switch 58 upon observing that the postage indicia die 14 (FIG. 1) is in need of ink 24. As a result, the power source 52 (FIG. 2) is momentarily connected to the set terminal "S" of the multivibrator 60, providing a high level signal at the output terminal "Q" of the multivibrator 60. The high level signal at the output terminal "Q" energizes the driver 76, which in turn actuates the solenoid 42, causing the transfer roller 34 (FIG. 1) to respectively engage the supply and inking rollers, 26 and 30. In the course of the next and each subsequent printing cycle of operation of the postage meter 10, the printing drum 12 rotates the postage indicia die 14 into engagement with the inking roller 30, causing ink 24 to be transferred from the reservoir 22 to the supply roller 26, from the supply roller 26 to the transfer roller 34, and from the transfer roller 34 to the inking roller 30 until the output signal at terminal "Q" of the multivibrator 60 is switched to a low level signal. As hereinbefore discussed, in the course of each printing cycle, the sensing device 50 provides the AND gate 68 with a gating signal 54 of fixed duration. The pulse generator is responsive to the high level signal from terminal "Q" of the multivibrator 60 to cause the pulse generator 62 to commence oscillation. And the AND gate 68 gates the pulses 64 during each printing cycle for the duration of the gating signal 54. Each successive group of pulses 70 gated by the AND gate 68 is counted by the counter 72 until a predetermined number of pulse 70 has been counted, depending on the number of printing cycles during which it is desirable to continue operation of the inking mechanism 16. Upon reaching the desired count, the counter 72 generates the reset signal 74 for switching the output signal at terminal "Q" of the multivibrator 60 to a low level signal which, in turn, deenergizes the driver 76 to deactuate the solenoid 42 and disables the pulse generator 62. Whereupon the transfer roller 34 (FIG. 1) is urged out of engagement with the supply and inking rollers, 26 and 30, to prevent the further transfer of ink 22 to the inking roller 30.

It is a feature of the invention to provide for premature discontinuance of operation of the inking mechanism 16, to for example allow for the operator to ink the printing die 14 for a relatively shorter time period to accommodate short mail run usages of the postage meter 10. To that end a multivibrator 60 of the type which includes a toggle terminal "T" rather than a set terminal "S" may be utilized. Whereupon, operation of the control apparatus 46 would in all respects be the same as in hereinbefore discussed excepting only that the operator may additionally manually provide a reset signal at the toggle terminal "T" by momentarily actuating the switch 58 after having initially commenced operation of the inking mechanism 16.

In accordance with the objects of the invention there has been described apparatus for controlling operation of the inking means of a machine, and in particular of a postage meter having a printing cycle.

Inasmuch as certain changes may be made in the above described invention without departing form the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. In a machine having printing cycles and including inking means, apparatus for controlling operation of said inking means comprising:

a. latching means including a manually operable switch;

b. pulse generating means operatively coupled to said latching means for enablement thereby in response to momentary operation of said switch to commence generating pulses;

c. means for counting a predetermined number of said pulses;

d. means for providing an inking enabling signal for a predetermined time interval during at least one of said printing cycles;

e. switching means connected to said pulse generating means and said inking enabling signal means and said counting means for gating said pulses to said counting means during the time interval of said inking enabling signal; and f. means connected to said pulse generating means for operating said inking means during the time interval said predetermined number of said pulses are being counted.

2. The apparatus according to claim 1, including said counting means connected to said latching means for disabling said pulse generating means when said predetermined number of said pulses has been counted.

3. The apparatus according to claim 1, wherein said pulse generating means includes means for varying the frequency of generation of said pulses, whereby the time period during which said pulses are counted by said counting means may be varied.

4. The apparatus according to claim 1, wherein said means for operating said inking means is connected to said latching means and includes a solenoid enabled by said latching means in response to momentary operation of said switch, whereby said inking means is operable for inking when said pulse generating means is enabled.

5. The apparatus according to claim 1, wherein said latching means includes a bistable multivibrator operable in one stable state for enabling said pulse generating means and operable in another stable state for disabling said pulse generating means, and said switch is connected to said multivibrator and adapted to be momentarily manually actuated for operation of said multivibrator in said one stable state.

6. The apparatus according to claim 5, wherein said counting means is connected to said latching means for operation of said multivibrator in said another stable state when said predetermined number of said pulses has been counted, whereby said pulse generating means is disabled when said predetermined number of said pulses has been counted.

7. The apparatus according to claim 5, including said switch adapted to be momentarily manually actuated for operation of said multivibrator in said another stable state, whereby inking may be terminated prior to said predetermined number of said pulses being counted.

8. The apparatus according to claim 5, wherein said means for operating said inking means includes a solenoid connected to said multivibrator and adapted to be enabled in response to operation of said multivibrator in said one stable state.

* * * * *

UNITED STATES PATENT AND TRADEMARK OFFICE

CERTIFICATE OF CORRECTION

PATENT NO. : 4,266,480

DATED : May 12, 1981

INVENTOR(S) : John L. Lorenzo

It is certified that error appears in the above-identified patent and that said Letters Patent are hereby corrected as shown below:

Column 1, line 20, change "Also" to -- And --.

Column 3, line 67, change "disablment" to -- disablement --.

Column 5, line 14, change "form" to -- from --.

Signed and Sealed this

*Eleventh* Day of *August 1981*

[SEAL]

*Attest:*

GERALD J. MOSSINGHOFF

*Attesting Officer*

*Commissioner of Patents and Trademarks*